US006189171B1

(12) United States Patent
Savkar et al.

(10) Patent No.: US 6,189,171 B1
(45) Date of Patent: Feb. 20, 2001

(54) WASHING MACHINE HAVING A VARIABLE SPEED MOTOR

(75) Inventors: Sudhir Dattatraya Savkar, Schenectady, NY (US); Richard Leland Butsch, Louisville, KY (US); John Marshall Hooker, Fort Wayne, IN (US); Richard Edward Hornung, Fisherville, KY (US); Walter Whipple, III, Amsterdam, NY (US)

(73) Assignee: General Electric Company, Schenectady, NY (US)

( * ) Notice: Under 35 U.S.C. 154(b), the term of this patent shall be extended for 0 days.

(21) Appl. No.: 09/268,304

(22) Filed: Mar. 16, 1999

(51) Int. Cl.[7] ..... D06F 37/40
(52) U.S. Cl. ..... 8/159; 68/23.7; 68/133
(58) Field of Search ..... 8/159; 68/23.7, 68/133

(56) References Cited

U.S. PATENT DOCUMENTS 2,505,741 * 4/1950 Nachumsohn ..... 68/133
2,526,969 * 10/1950 Powers ..... 68/23.7
2,841,003 * 7/1958 Conlee ..... 68/23.7 X
3,003,345 * 10/1961 Green ..... 68/23.7 X
3,128,615 * 4/1964 Mahaffay ..... 68/23.7 X
3,152,463 * 10/1964 Sones et al. ..... 68/23.7 X
4,390,826 * 6/1983 Erdman et al. ..... 318/439
4,631,771 * 12/1986 Anderson et al. ..... 68/23.7 X
4,813,248 3/1989 Smith et al. ..... 68/23.7
4,914,331 * 4/1990 Lewis ..... 68/133 X
5,005,383 * 4/1991 Clawson et al. ..... 68/23.7 X

* cited by examiner

*Primary Examiner*—Philip R. Coe
(74) *Attorney, Agent, or Firm*—David C. Goldman; Jill M. Breedlove

(57) ABSTRACT

A washing machine having a variable speed motor. The washing machine has a basket for holding articles to be washed and has a first axis of rotation. A basket drive shaft connected to the basket drives the basket. An agitator disposed in the basket along the first axis of rotation agitates the article in the basket. An agitator drive shaft connected to the agitator drives the agitator. A variable speed motor, having a second axis of rotation which is not coincident with the first axis of rotation, drives the basket drive shaft and the agitator drive shaft. A coupler couples motion of the variable speed motor to the agitator drive shaft and basket drive shaft.

11 Claims, 7 Drawing Sheets

WASHING MACHINE HAVING A VARIABLE SPEED MOTOR

BACKGROUND

The present invention relates generally to washing machines, and more particularly to a washing machine which includes an off-axis variable speed motor coupled to an agitator and a basket.

Conventional washing machines typically include a basket that holds articles such as clothes to be washed, an agitator disposed within the basket which agitates the clothes in the basket, and a motor which drives the agitator and the basket. The motor is typically an AC induction motor, which can reverse its rotation direction to achieve different modes in the wash cycle. The motor, for example, may rotate in a first direction during the agitation mode and a second direction, opposite the first direction, in the spin mode. A transmission is provided with gears to convert the rotary motion of the motor into oscillatory motion of the agitator during agitation, or high speed rotation during the spin mode. In addition, associated with a typical transmission are a brake to hold the transmission (and hence the basket) immobile during agitation mode and a clutch or actuator to engage or disengage the brake. An additional slip clutch is typically installed between the motor and the agitator, since the induction motor typically cannot immediately generate the full torque required.

Although washing machines powered by AC induction motors generally operate in a satisfactory manner, they are generally both complicated and inflexible. For example, the transmission is a relatively complex unit that includes many moving parts and contributes substantially to the reliability and cost of the washing machine. It is also configured to provide only a limited number of options with regard to the motion of the basket and agitator.

To overcome some of the limitations of conventional AC induction motor powered washing machines, variable speed reversible electric motors have been implemented to simplify the construction of washing machines and to allow more flexibility in controlling the motion of the basket and agitator. For example, U.S. Pat. No. 4,813,248 issued Mar. 21, 1989 to Smith et al. discloses a washing machine that includes a three-phase electronically commutated motor (3ϕ ECM) which directly drives the agitator and basket. The rotational speed and direction of the 3ϕ ECM can be controlled with electronic commutation equipment which enables the 3ϕ ECM to move in a clockwise and counterclockwise motion causing the agitator to be oscillated clockwise and counterclockwise in agitation mode. The electronic commutation equipment also drives the motor continuously in spin mode to spin the agitator and basket.

Although the Smith et al. apparatus has certain advantages over prior AC induction motor powered washing machines, it also has several disadvantages. For example, the direct drive arrangement, in which the 3ϕ ECM is arranged on the same axis of rotation as the basket and agitator, results in the transmission of torque ripple vibrations from the 3ϕ ECM to the tub, basket, agitator, and other parts of the washing machine. The transmission of torque ripple through the direct drive arrangement generates a significant amount of noise, which is an undesirable feature in a washing machine. Torque ripple also has adverse effects on other components of the washing machine, which are vibrated during use and thus may be fatigued. The effects of torque ripple are augmented by the low frequency at which the motor is operated, which frequency often coincides with the natural oscillating frequency of the washing machine or its subsystems. Thus, the transmission of vibrations and noise from the 3ϕ ECM to other components of the washing machine is, unfortunately, very efficient.

In addition, the placement of the 3ϕ ECM directly below the agitator and basket introduces significant constraints with respect to the design of the 3ϕ ECM. There is a limited amount of space under the agitator and basket due to the desire to provide a large basket while keeping the height of the washing machine at a comfortable level. Thus, the 3ϕ ECM must be designed to have a relatively small height and a large number of poles, which adds to the cost of the washing machine.

It would be desirable, therefore, to have a washing machine that provided the flexibility of a variable speed reversible electric motor, for example, while avoiding the problems of known variable speed motor powered washing machines.

SUMMARY

The above-mentioned need is met by the present invention which provides a washing machine having a basket for holding an article to be washed and a basket drive shaft connected to the basket for driving the basket about a first axis of rotation. An agitator is disposed in the basket along the first axis of rotation, for agitating the article in the basket, and an agitator drive shaft is connected to the agitator for driving the agitator. A variable speed motor, having a second axis of rotation which is not coincident with the first axis of rotation, is provided for driving the basket drive shaft and the agitator drive shaft. A coupler couples motion of the variable speed motor to the agitator drive shaft and basket drive shaft. The coupler preferably comprises a compliant belt and pulley drive, a worm and gear drive, or a bevel gear drive. Exemplary embodiments of the invention significantly reduce the efficiency with which vibrations and noise from the motor are transmitted into the washing machine and its subsystem components.

BRIEF DESCRIPTION OF THE DRAWINGS

Other features and advantages of the invention will be more readily understood upon reading the following detailed description, taken in conjunction with the drawings, in which.

DETAILED DESCRIPTION OF THE PREFERRED EMBODIMENTS

Figure 1:
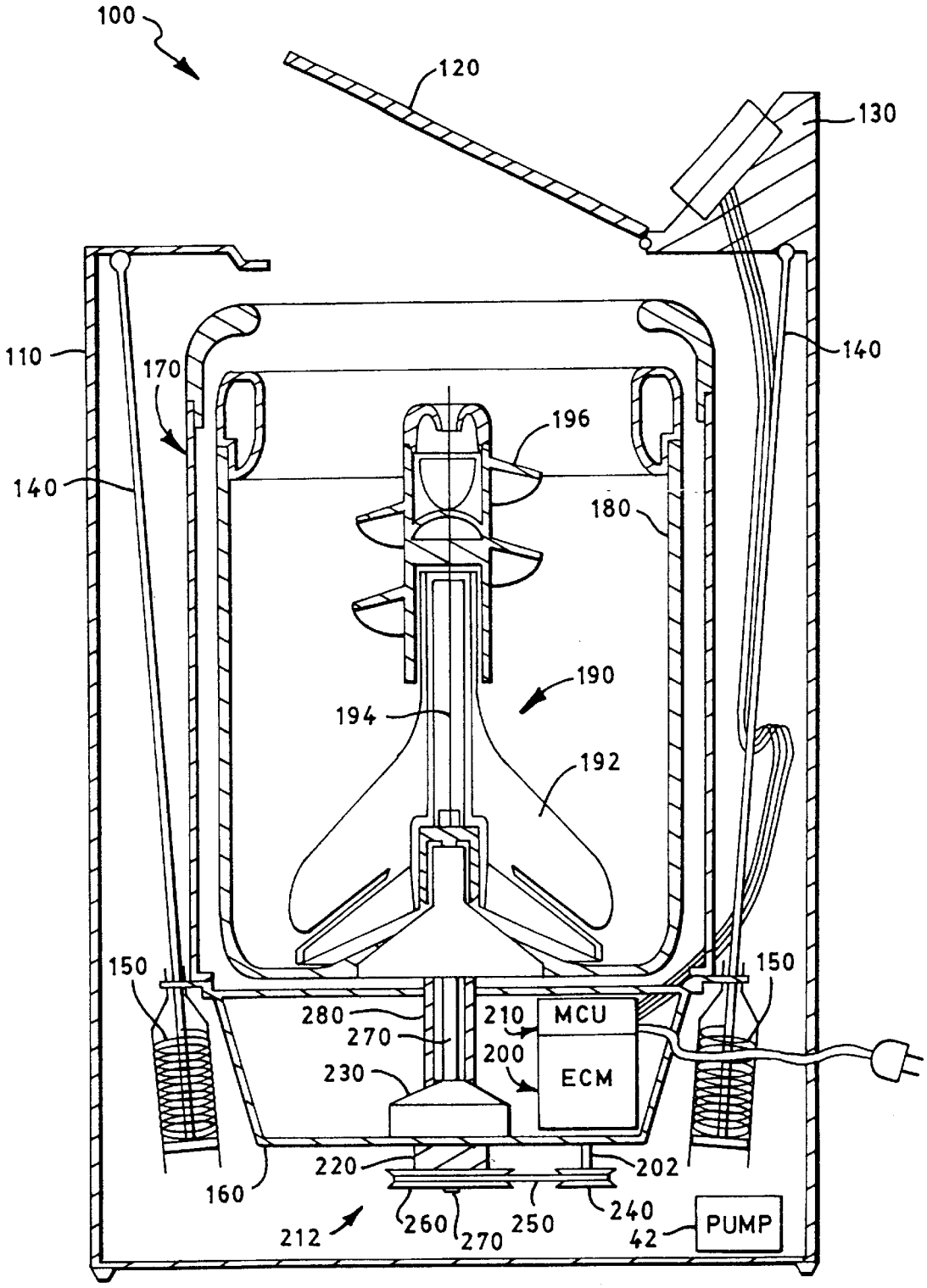
FIG. 1 is a drawing of a washing machine according to an exemplary embodiment of the invention.

FIG. 1 shows a washing machine 100 according to an exemplary embodiment of the invention. The washing machine 100 includes a cabinet 110 which supports components of the washing machine 100, and a backsplash 130 on which are mounted controls, a display, and water valves, for example. Supported by the cabinet 110 is a suspension system that includes rods 140, springs 150, and a platform 160. The suspension system, which can be that described in commonly-owned U.S. Pat. No. 5,520,029, entitled "Coil Spring and Snubber Suspension System for a Washer", by Savkar, provides the advantage of low transmissibility of the out-of-balance forces to the cabinet 110, which improves the stability of the washing machine 100 and reduces system noise.

Supported on the platform 160 are the tub 170, the basket 180, the agitator 190, the motor 200, the motor control unit 210, the mode shifter 220, and the brake 230. The basket 180 holds articles such as clothes to be washed, and the agitator 190 agitates the clothes in the basket 180. The agitator 190 is typically molded out of a plastic such as polypropylene and typically includes a plurality of vanes 192. The vanes 192 are typically flexible and mechanically agitate the clothes as the agitator 190 oscillates about the drive axis 194. The washing machine 100 may also include an auger 196 at the top of the agitator. The auger 196 further enhances the movement of the clothes within the basket 180. The basket 180 and agitator 190 are coaxially located within the tub 170 which retains the wash liquid (e.g., detergent and water) during the wash cycle. A pump 42 is provided to remove the wash liquid from the tub 170 when the wash cycle or rinse cycle is completed.

To power the washing machine 100, a variable speed motor 200 is provided. The motor 200 is coupled to the basket 180 and agitator 190 through a coupler 212, a mode shifter 220, an agitator drive shaft 270, and a basket drive shaft 280. In the embodiment of FIG. 1, the coupler 212 includes a motor pulley 240 connected to a shaft 202 of the motor 200, a drive pulley 260 connected to the agitator drive shaft 270, and a belt 250 connecting the motor pulley 240 and the drive pulley 260.

The motor 200 of the washing machine is a variable speed motor, such as an electronically commutated motor (ECM). The variable speed motor is advantageous, because its rotational velocity and torque can be easily controlled, as compared, for example, with a traditional single phase AC induction motor. A variable speed motor can be programmed with an algorithm to measure the torque induced in proportion to the clothes load. The resulting signal can be transmitted to the MCU 210 during the fill operation to fill the tub 170 with just enough water to efficiently wash the clothes, thereby minimizing the water and energy usage. Examples of variable speed motors include brushless DC motors (e.g., electronically commutated motors and switched reluctance motors), universal motors, DC motors, phase-controlled, single phase induction motors, and three phase inverter driven induction motors.

Preferably, the variable speed motor 200 is a single phase ECM, although a three-phase ECM can also be used. The ECM has stator windings which may be wound and connected, as required, on an iron core, and a rotor disposed within the stator. The rotor has positioned therein a plurality of arcuate magnets. Commutation of the windings is achieved by a solid state circuit controlled by suitable means for sensing rotor position. One example of a suitable single phase ECM is the 44 FRAME motor manufactured by the General Electric Company.

Because the torque, speed and rotational direction of the variable speed motor 200 are easily controlled, the washing machine 100 can operate without a transmission, as in conventional washing machines, to change the direction of motion during the agitation mode. The motion of the agitator 190 and basket 180 in the various modes of the wash cycle is achieved with the motor control unit 210. The motor control unit (MCU) 210 includes a microprocessor or microcontroller which is programmed to control the currents and voltages input to the stator coil over time. For example, the MCU 210 may be programmed to control the current input to the stator windings to effect a motor reversal and thus an oscillatory motion which oscillates the agitator 190 in agitate mode. In spin mode, the frequency of power supplied to the stator coil may be increased to increase the rotational velocity of the basket 180 and agitator 190. The MCU 210 may also be programmed to effect regenerative braking, in which power to the stator coil is controlled to apply a torque to the rotor in a direction opposite the rotational velocity of the rotor. The rotor can also be stopped by shorting the windings of the stator.

Figure 2:
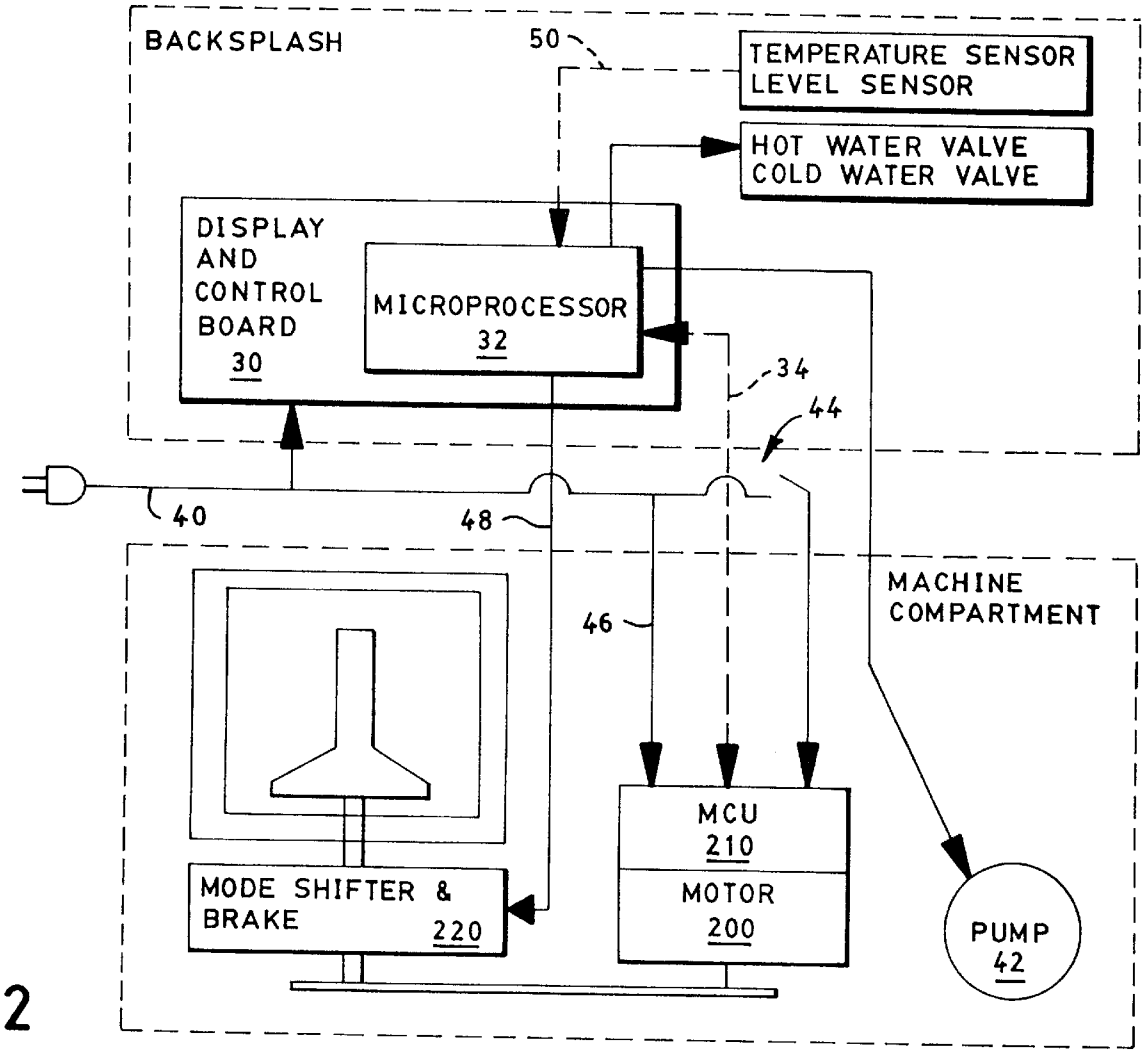
FIG. 2 is a diagram of an exemplary electrical system for the washing machine of FIG. 1.

FIG. 2 is a schematic drawing of the electrical system of the washing machine 100 according to an exemplary embodiment of the invention. The washing machine includes a display and control board 30 which displays information on the washing machine and wash cycle and which includes buttons or other suitable input mechanism for allowing a user to select wash cycle options. For example, the display and control board 30 typically includes buttons for selection of water level, spin and agitation speeds, and an on/off switch. The display and control board 30 includes a microprocessor or microcontroller 32 which controls components of the washing machine, e.g. the hot and cold water valves and MCU 210, based on the user's selections and feedback from the washing machine sensors, e.g., water temperature and level sensors.

The machine compartment of the washing machine houses the MCU 210 that includes its own microprocessor (not shown), according to an exemplary embodiment. A low voltage communication link 34 allows the two microprocessors to communicate. An AC power line 40 powers the hot and cold water valves and the drain pump 42 through the display and control board 30. The AC power line 40 powers the motor 200 through the MCU 210. A lid switch 44 is provided to enable interruption of power supply to the motor 200 in the event that the lid of the washing machine is opened. A direct DC power line 46 is provided to power the MCU 210. A controlled power line 48 may be provided to control the mode shifter 220 if the mode shifter is electromechanically actuated. The water temperature and level sensors may be connected to the microprocessor 32 with a low voltage line 50.

Referring again to FIG. 1, the motor 200 is coupled to the agitator drive shaft 270 by the coupler 212 which is a belt drive system including a motor pulley 240, a drive pulley 260, and a belt 250. The motor 200 has a rotational axis that is not coincident with the rotational axis of the agitator 190 and basket 180. This configuration reduces the transmission of torque ripple vibrations from the motor to the agitator, basket and other components of the washing machine. In addition, the coupler 212 constitutes a compliant coupling since the belt 250 is typically made of an elastic material which reduces the transmission of motor torque pulsations into the washing machine and its subsystems.

Typically, the radius of the drive pulley 260 is about 4–16 times greater than the radius of the motor pulley 240. According to one embodiment, the ratio of the drive pulley radius to the motor pulley radius is between about 12:1 and about 8:1. Thus, the rotational velocity of the ECM is typically between 4 and 16 times the rotational velocity of the agitator drive shaft 270. This ratio is implemented to allow the motor 200 to operate at a higher rotational velocity than the agitator 190 and basket 180 which it drives. The agitator 190 and basket 180 are typically oscillated or rotated at a frequency that is close to the natural oscillating frequency of the washing machine 100. Because the motor pulley 240 has a radius which is smaller than the radius of the drive pulley 260, the motor 200 rotates at a rotational velocity which is larger and more remote from the natural oscillating frequency of the washing machine 100 and its components. Therefore, transmission of vibrations and noise from the motor 200 to the washing machine 100 is significantly reduced.

Figure 3:
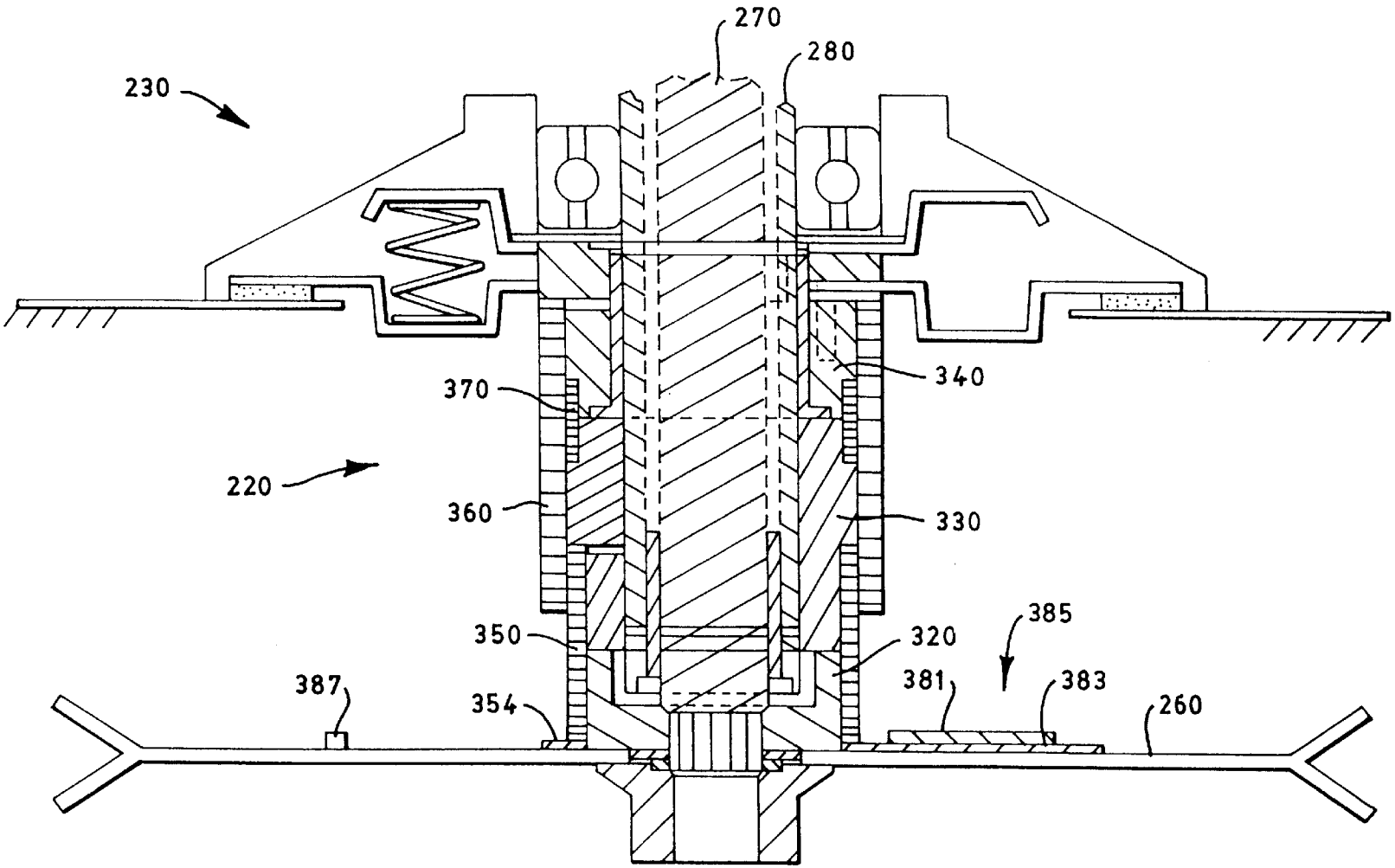
FIG. 3 is a drawing of the mode shifter of the washing machine shown in FIG. 1.

The drive pulley 260 drives the agitator drive shaft 270 and basket drive shaft 280 through a mode shifter 220. An exemplary embodiment of the mode shifter 220 is shown in more detail in FIG. 3. The function of the mode shifter is to execute different modes in the wash cycle. For example, during the agitation mode, the mode shifter 220 allows the agitator drive shaft 270 to oscillate while the basket drive shaft 280 may be held stationary. In spin mode, both the basket drive shaft 280 and the agitator drive shaft 270 are rotated together at a high speed. The mode shifter 220 works in conjunction with a brake 230, also shown in FIG. 3, which stops the rotational velocity of the basket 180 and thus the agitator 190 if the lid 120 of the washing machine is opened during spin mode, for example. The mode shifter 220 is described in detail in commonly-owned U.S. application Ser. No. 08/939,070 entitled "Mode Shifter For a Washing Machine ", by Thompson et al. and filed on Sep. 29, 1997, which is hereby incorporated by reference.

The mode shifter 220, according to an exemplary embodiment of the invention, includes an agitator collar 320 coupled to the agitator drive shaft 270, a basket collar 330 coupled to the basket drive shaft 280, and a brake collar 340 coupled to the brake 230. The mode shifter 220 includes three springs which are disposed around the three collars 320, 330, 340. A first, basket engagement spring 350 is disposed around both the agitator collar 320 and the basket collar 330. A second, brake engagement spring 360 is disposed around the brake collar 340, the basket collar 330, and the basket engagement spring 350. A third, basket immobilizer spring 370 may be disposed in a recess on peripheral portions of the brake collar 340 and the basket collar 330.

The three springs 350, 360, 370 perform the function of clamping the collars together during different modes of the wash cycle. Clamping is accomplished by winding the springs more tightly around a pair of collars such that the friction between the spring and the collar is increased to the point at which the spring acts to clamp the collars rotationally together.

In agitation mode, the motor power is applied to the agitator collar 320 in an oscillatory manner by periodically reversing the direction of the variable speed motor 200. The agitator collar 320 rotates alternately in both directions within the basket engagement spring 350 at a rate and stroke controlled by the MCU 210.

The transition from agitation mode to spin mode can be achieved by continuously turning the motor 200 in a predetermined direction to engage a spring engagement member 354 which extends radially outwardly from the bottom of the basket engagement spring 350. The motor 200 rotates the drive pulley 260 so that a pulley engagement member 387 comes into contact with a mode shift actuator 385. The mode shift actuator 385 is free to rotate independently and includes an inwardly extending arm 381 which engages the spring engagement member 354 to tighten the basket engagement spring 350 around the agitator collar 320 and basket collar 330. The basket engagement spring 350 thus locks together the basket collar 330 and the agitator collar 320 so that the basket 180 and agitator 190 rotate together in spin mode.

As long as the agitator collar 320 is supplied with a small spin torque from the motor, the basket engagement spring 350 of the mode shifter remains locked around the agitator collar 320 and basket collar 330. If the spin torque is interrupted, the basket engagement spring 350 will unwind, releasing the basket collar 330 and the agitator collar 320. At the same time, the outer diameter of the basket engagement spring 350 increases, so that it comes into contact with the inner surface of the brake engagement spring 360. The friction between the basket engagement spring 350 and the brake engagement spring 360 winds the brake engagement spring 360 more tightly around the basket collar 330, brake collar 340, and basket engagement spring 350, creating a positive feedback effect which locks the basket collar 330 and brake collar 340 together. When the basket collar 330 is locked to the brake collar 340, energy is dumped into the braking system, and the basket 180 quickly stops.

The basket immobilizer spring 370 may be provided to work in conjunction with the brake engagement spring 360 to prevent the basket 180 from rotating in either direction during agitation mode. The basket immobilizer spring 370 has an interference fit with both the brake collar and the basket collar, and is wound in a direction opposite to the winding direction of both the basket engagement spring 350 and the brake engagement spring 360. The basket immobilizer spring 370 locks together the basket collar 330 and the brake collar 340 through a positive feedback friction effect when reaction torques from the clothes torque the basket 180 in the direction opposite the spin mode direction. The brake engagement spring 360 prevents the basket from rotating due to reaction torques of the basket in the spin mode direction. Thus, the basket immobilizer spring 370 and the brake engagement spring 360 together prevent the basket from rotating in either in agitation mode.

Figure 4:
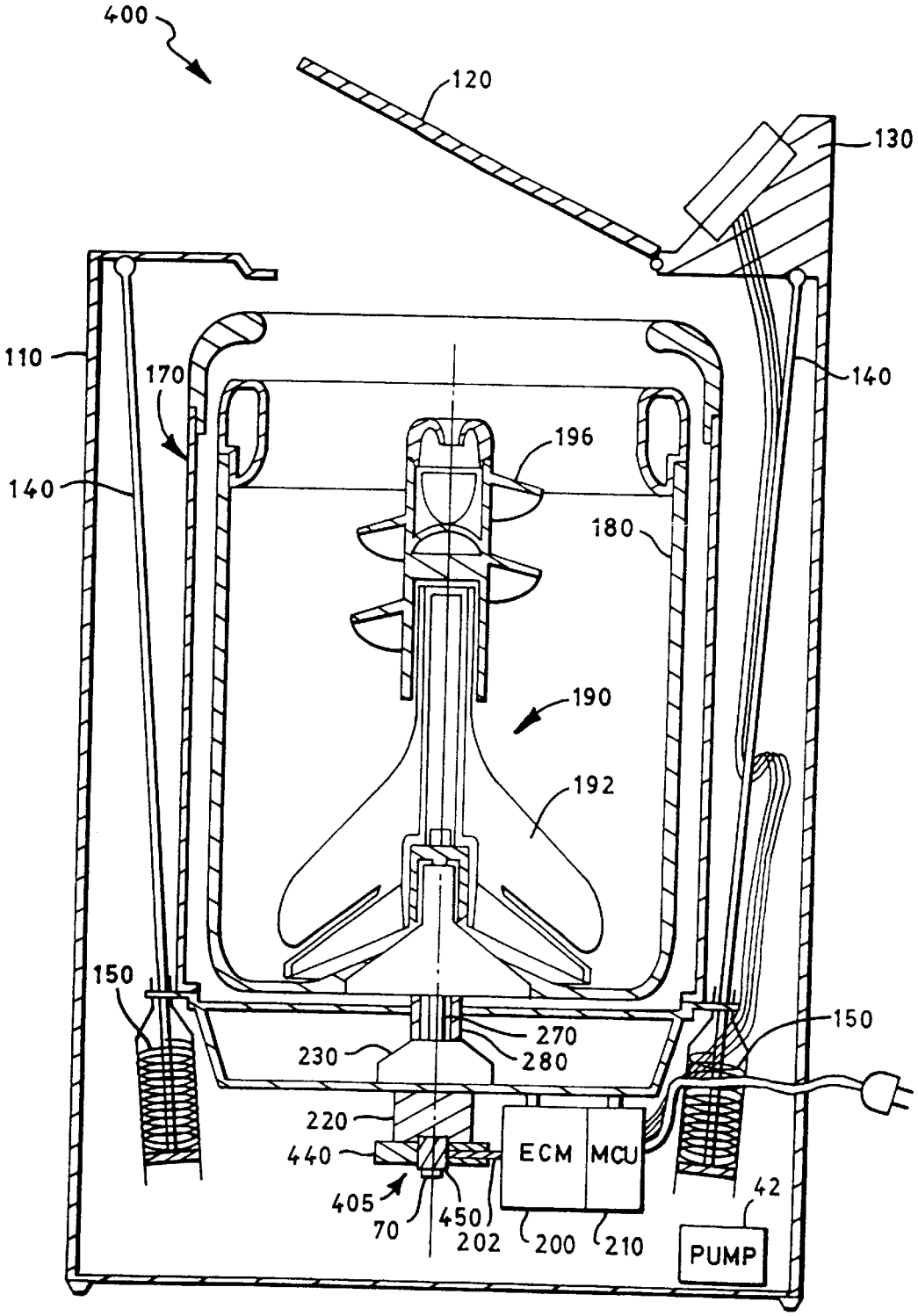
FIG. 4 is a drawing of a washing machine according to another embodiment of the invention.

FIG. 4 illustrates a washing machine 400 according to another embodiment of the invention. The washing machine 400 of FIG. 4 includes many components which are the same as those shown in FIG. 1, and description of these components will not be repeated for brevity.

Figure 5:
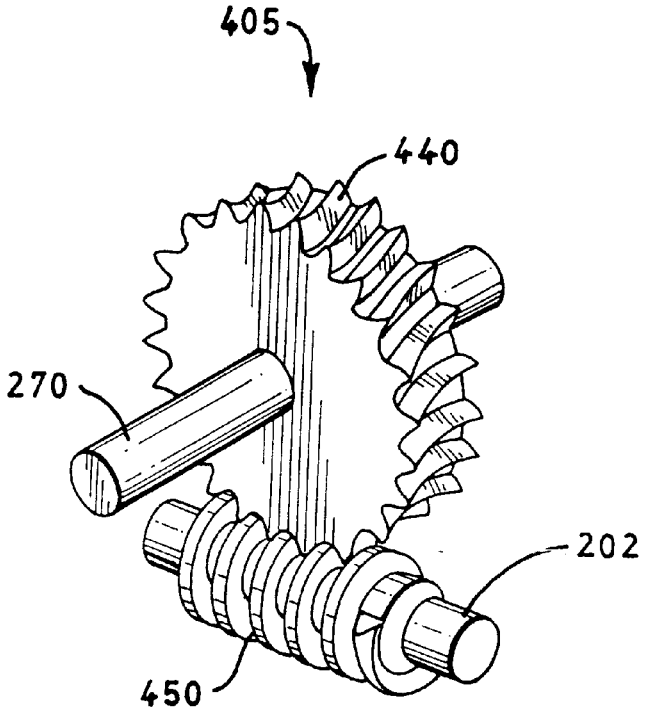
FIG. 5 is a drawing of the worm and gear coupler of the washing machine shown in FIG. 4.

In FIG. 4, the motor 200 is coupled to the agitator drive shaft 270 with a coupler 405 in the form of a worm and gear drive. The worm and gear coupler 405, which is shown in greater detail in FIG. 5, includes a worm 450 fixedly connected to the motor shaft 202 and a gear 440 fixedly connected to the agitator drive shaft 270. The motor shaft 202 and the agitator drive shaft 270 are arranged perpendicularly so that worm 450 meshes with gear 440. The worm 450 is in the form of a helix, forming a continuous tooth, and the gear 440 has independent teeth and is driven by the rotation of the worm 450.

As in the belt drive system shown in FIG. 1, the dimensions of the worm and gear coupler 405 can be designed such that the motor shaft 202 has a different rotational velocity than the agitator drive shaft 270 which it drives. For example, the dimensions of the worm 450 and gear 440 can be designed such that for every revolution of the agitator drive shaft 270, the motor shaft 202 revolves between about 4 and about 16 times, preferably between about 8 and about 12 times. This ratio is implemented to allow the motor 200 to operate at a higher rotational velocity than the agitator 190 and basket 180 which it drives, which reduces the transmission efficiency of vibrations and noise from the motor 200 to the washing machine 100. The worm and gear coupler 405 is also effective in braking the rotation of the basket and agitator, since the efficiency with which the gear 440 can drive the worm 450 is relatively low. Thus, breaking the motion of the basket and agitator is effective, even with no power from the motor.

Figure 6:
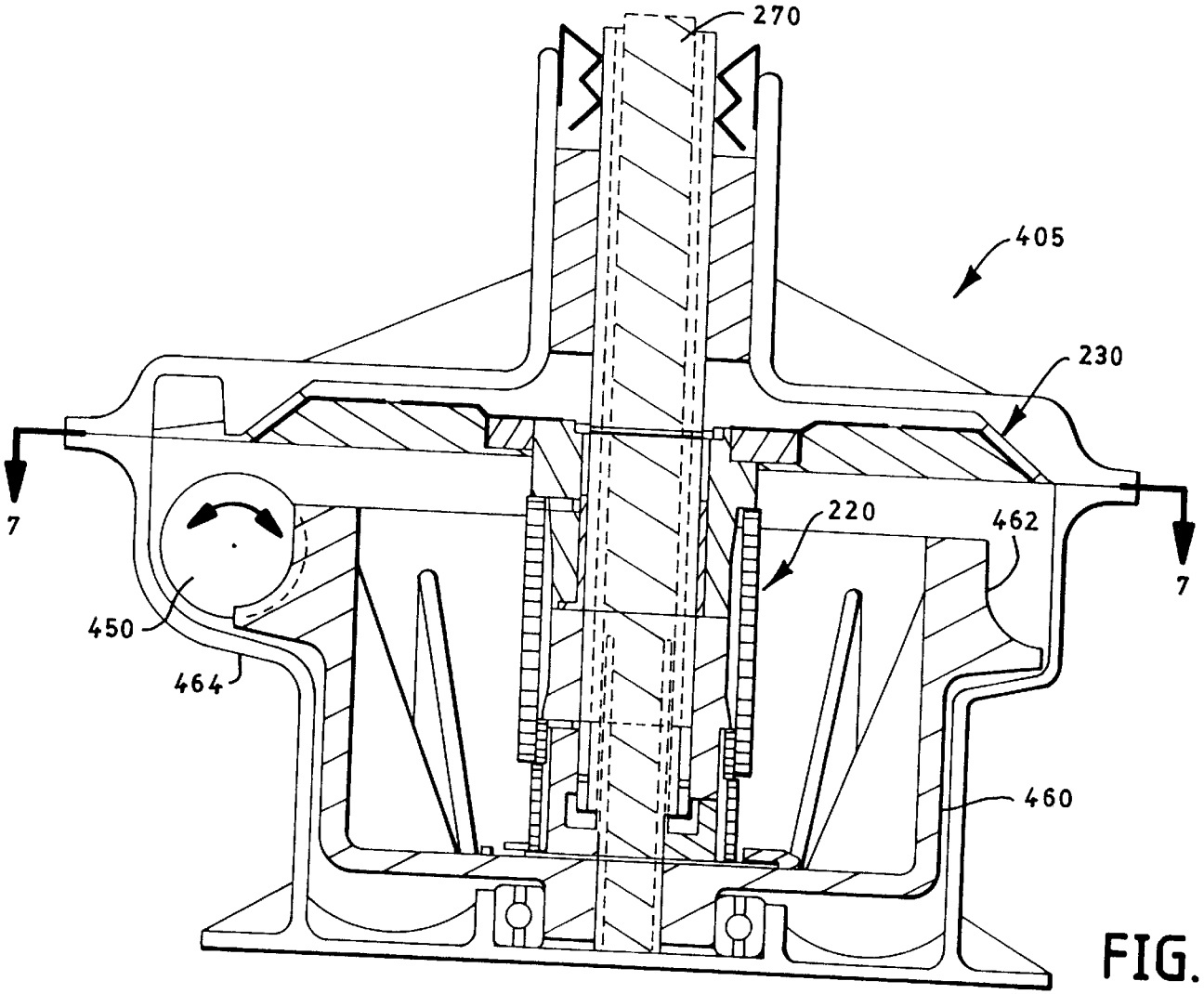
FIG. 6 is a drawing of another worm and gear coupler.
Figure 7:
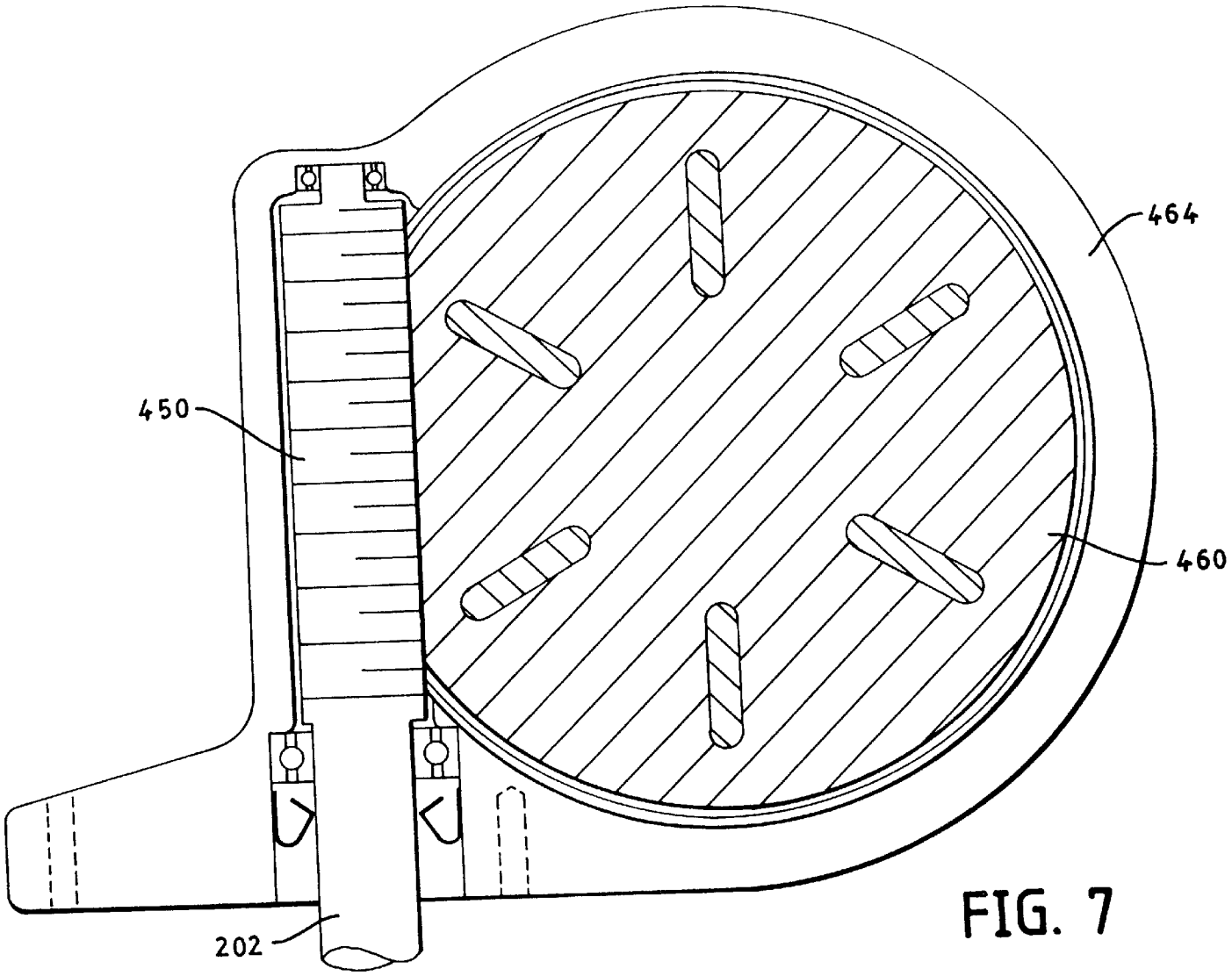
FIG. 7 is a sectional view of the worm and gear coupler taken along line 7—7 of FIG. 6.

FIGS. 6 and 7 show a variant of the worm and gear coupler 405. In this case, the flat gear 440 is replaced with a cup-shaped gear 460. The cup-shaped gear 460 is a cylindrical member closed on its bottom and having an annular gear ring 462 formed on its outside surface at its upper end. The gear 460 is fixedly connected to the agitator drive shaft 270 and is rotatively mounted within a housing 464. The cup shape of the gear 460 allows the mode shifter 220 to be disposed within the gear 460 so as to conserve space. The brake 230 is also disposed within the housing 464. The worm 450, which is fixedly connected to the motor shaft 202, is arranged so as to mesh with the gear ring 462.

Figure 8:
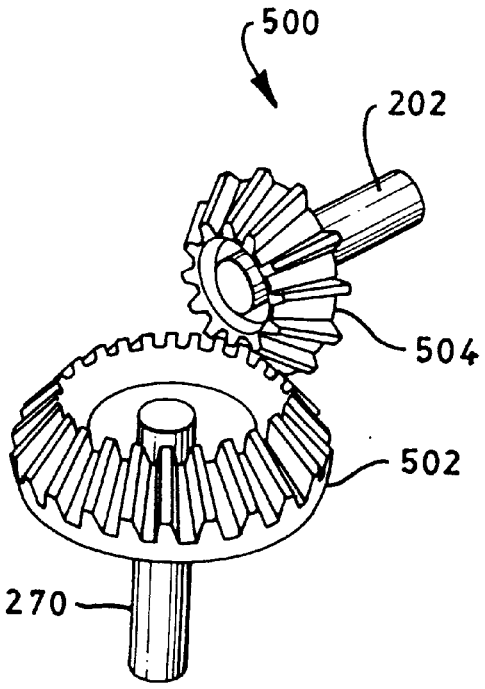
FIG. 8 is a drawing of a bevel gear coupler according to another embodiment of the invention.

FIG. 8 illustrates another embodiment of the invention that includes a bevel gear coupler 500. The bevel gear coupler 500 includes a first bevel gear 502 that engages a second bevel gear 504 disposed perpendicular to the first bevel gear 502. The first bevel gear 502 is fixed to the agitator drive shaft 270, and the second bevel gear 504 is fixed to the motor shaft 202. As in the belt drive system of FIG. 1 and the worm and gear drive system of FIGS. 5–7, the dimensions of the bevel gear coupler 500 can be designed such that the motor shaft 202 has a different rotational velocity than the agitator drive shaft 270 which it drives. For example, the dimensions of the first bevel gear 502 and the second bevel gear 504 can be designed such that for every revolution of the agitator drive shaft 270, the motor shaft 202 revolves between about 4 and about 16 times, preferably between about 8 and about 12 times. This ratio is implemented to allow the motor 200 to operate at a higher rotational velocity than the agitator 190 and basket 180 which it drives, which reduces the transmission efficiency of vibrations and noise from the motor 200 to the washing machine 100.

Exemplary embodiments of the invention thus provide several advantages over prior washing machines. For example, the unequal rotation velocities of the motor and the agitator drive shaft significantly reduces the efficiency with which vibrations and noise from the motor are transmitted into the washing machine, thus reducing machine noise and increasing machine reliability and quality. In addition, the MCU provides great flexibility in adapting or modifying the operation of the washing machine to particular washing requirements, since the speed, position, direction, and torque of the motor are easily programmable. For example, an agitation stroke profile can be tailored to particular articles of clothing using the MCU. The MCU also allows a symmetric agitation stroke to be executed, in contrast to the asymmetric agitation stroke produced by a conventional transmission. The positioning of the motor off the axis of rotation of the agitator and basket eliminates many design constraints with regard to the physical shape of the motor, and reduces the transmission of vibrations from the motor to other components of the washing machine.

While the invention has been described with reference to exemplary embodiments, it will be understood by those skilled in the art that various changes and modifications may be made without departing from the scope of the invention. It is intended that the invention not be limited to the particular embodiments disclosed, but that the invention will include all embodiments falling within the scope of the appended claims.

What is claimed is:

1. A washing machine comprising:

a basket having a first axis of rotation;

a basket drive shaft connected to the basket;

an agitator disposed in the basket along the first axis of rotation;

an agitator drive shaft connected to the agitator;

an electronically commutated motor for driving the basket drive shaft and the agitator drive shaft, the electronically commutated motor having a second axis of rotation which is not coincident with the first axis of rotation; and a coupler connected to the agitator drive shaft and the electronically commutated motor to couple motion of the electronically commutated motor to the agitator drive shaft, wherein the coupler comprises a motor pulley connected to the electronically commutated motor; a drive pulley connected to the agitator drive shaft; and a belt which couples the motor pulley to the drive pulley.

2. The washing machine of claim 1, wherein the coupler includes an elastic element which inhibits the transmission of vibrations of the electronically commutated motor.

3. The washing machine of claim 1, wherein the coupler effects a change in rotational velocity between the electronically commutated motor and the agitator drive shaft.

4. The washing machine of claim 1, wherein the motor pulley has a first radius, the drive pulley has a second radius, and the first radius is not equal to the second radius.

5. The washing machine of claim 1, wherein the drive pulley has a first radius, the motor pulley has a second radius, and a ratio of the first radius to the second radius is between about 4:1 and about 16:1.

6. The washing machine of claim 1, wherein the drive pulley has a first radius, the motor pulley has a second radius, and a ratio of the first radius to the second radius is between about 8:1 and about 12:1.

7. The washing machine of claim 1, wherein the electronically commutated motor comprises a single-phase electronically commutated motor.

8. A method of operating a washing machine comprising the steps of:

supporting a basket and an agitator on a first axis of rotation;

supporting an electronically commutated motor on a second axis of rotation not coincident with the first axis of rotation;

coupling the electronically commutated motor to an agitator drive shaft, wherein the step of coupling the electronically commutated motor comprises fixing a motor pulley to the electronically commutated motor; fixing a drive pulley to the agitator drive shaft; and coupling the motor pulley to the drive pulley with a belt; and rotating the electronically commutated motor to rotate the agitator drive shaft.

9. The method of claim 8, wherein the step of coupling the electronically commutated motor comprises the step of inhibiting the transmission of vibrations from the electronically commutated motor.

10. The method of claim 8, further comprising the step of making a radius of the motor pulley not equal to a radius of the drive pulley.

11. The method of claim 8, further comprising the steps of:

forming the drive pulley to have a first radius;

forming the motor pulley to have a second radius;

wherein a ratio of the first radius to the second radius is between about 4:1 and about 16:1.

* * * * *